US005197213A

United States Patent [19]

Borden

[11] Patent Number: 5,197,213

[45] Date of Patent: Mar. 30, 1993

[54] DECORATIVE FRAMING BORDER OR ENCLOSURE DEVICE

[76] Inventor: Mary E. Borden, 88 Hawthorne, Akron, Ohio 44303

[21] Appl. No.: 842,946

[22] Filed: Feb. 27, 1992

Related U.S. Application Data

[63] Continuation-in-part of Ser. No. 660,649, Feb. 25, 1991, abandoned.

[51] Int. Cl.[5] ..... A47G 1/06

[52] U.S. Cl. ..... 40/152; 40/152.1

[58] Field of Search ..... 40/152, 152.1, 154, 40/155, 156

[56] References Cited

U.S. PATENT DOCUMENTS

| | | | |
|---|---|---|---|
| 83,797 | 11/1868 | Schmitt | 40/154 |
| 737,124 | 8/1903 | Manor | 40/154 |
| 1,388,010 | 8/1921 | Watson | 40/152.1 |
| 4,850,125 | 7/1989 | Green | 40/152 |

*Primary Examiner*—James R. Brittain
*Assistant Examiner*—Brian K. Green
*Attorney, Agent, or Firm*—Oldham, Oldham & Wilson Co.

[57] ABSTRACT

A decorative framing border or enclosure device is described. The border or enclosure device contains transparent polymer or copolymer outer framing members positioned along the peripheral edges of a base framing member. The composition of the base framing member can be varied to be an acrylic resin, a polystyrene, a polycarbonate, a polyester resin, a non-crystalline polyolefin, and an unsaturated polyester resin copolymerized with styrene, a corkboard, a mirrored surface, a pegboard, etc. The transparent polymer or copolymer outer framing members are adapted to accommodate appearance-altering material therein. The border or enclosure device is so constructed as to permit the changing of a picture or mat which surrounds the picture without simultaneously affecting the appearance-altering material disposed within the outer framing members by isolating the two components to opposing surfaces of the base framing member. The decorative framing border or enclosure device is also described in a kit form.

17 Claims, 3 Drawing Sheets

DECORATIVE FRAMING BORDER OR ENCLOSURE DEVICE

This is a continuation-in-part of copending application Ser. No. 07/660,649 filed on Feb. 25, 1991, now abandoned.

TECHNICAL FIELD

The present invention relates to transparent or translucent polymeric decorative framing borders and/or enclosure devices, the unique component being the ability to enclose appearance-altering or decorative material within at least one hollow enclosure component of the frame.

BACKGROUND OF THE INVENTION

Conventional frames are typically assembled by joining frame members having connection surfaces cut to 45° at both sides to be assembled at right angles to each other, attaching L-shaped corner connection fittings to the connecting parts, fixing them to the frame member by rivets or set screws and assembling frame members to a square or rectangular frame.

Frame picture units typically comprise a picture assembly of a transparent protecting cover (made of glass or plastic), a mat, a picture and a backing board (in that order from front to back), the outside edges of which are encased in a frame. The most common frames are rectangular or square in plan and typically comprise four framing members joined together with ends mitered at a 45° angle. The framing members may be made of, for example, wood, metal or plastic. When made of wood, the frame members have an outer surface that is typically decoratively shaped or carved, and an inner surface. The inner surface is usually L-shaped in cross-section, comprising a flat front surface which engages the protective cover and a flat side surface. When using wooden framing members, the members are usually glued or nailed together to form the frame. The assembly is placed in the frame with the protective cover engaging the front inner surface, and tacks or other retaining members are driven into the flat inner side surface of each framing member to secure the picture assembly in the frame. While wood has for years been the most common framing material, metal and plastic frames are also in common use. Most metal framing members, like wood framing members, also have mitered ends cut at a 45° angle, however, the means for joining them together is different.

SUMMARY OF THE INVENTION

In accordance with the present invention, there is provided a transparent or translucent polymeric decorative framing border or enclosure device which can enclose a picture, a bulletin board, a vanity mirror, a towel bar rod, a doorknob, a toilet seat, a clock, a light switch, etc., the unique component being the ability to include appearance-altering or decorative material within a hollow enclosure.

It is an object of this invention to provide a transparent or translucent picture frame wherein at least one framing member has an inwardly opening recess to allow decorative material and/or inserts to be positioned therein.

It is a second object of this invention to provide a picture frame which is capable of having the picture changed without affecting or altering the appearance-altering material positioned in the inwardly opening recesses of the framing members.

It is a third object of this invention to provide a decorative framing or enclosure device at a low cost.

It is a fourth object of this invention to provide decorative framing or enclosure devices in kit form.

These and other objects of this invention will be evident when viewed in light of the drawings, detailed description, and appended claims.

DETAILED DESCRIPTION OF THE DRAWINGS

The invention may take physical form in certain parts and arrangements of parts, a preferred embodiment of which will be described in detail in the specification and illustrated in the accompanying drawings which form a part hereof, and wherein.

DETAILED COMPONENT PART LIST

Figure 1:
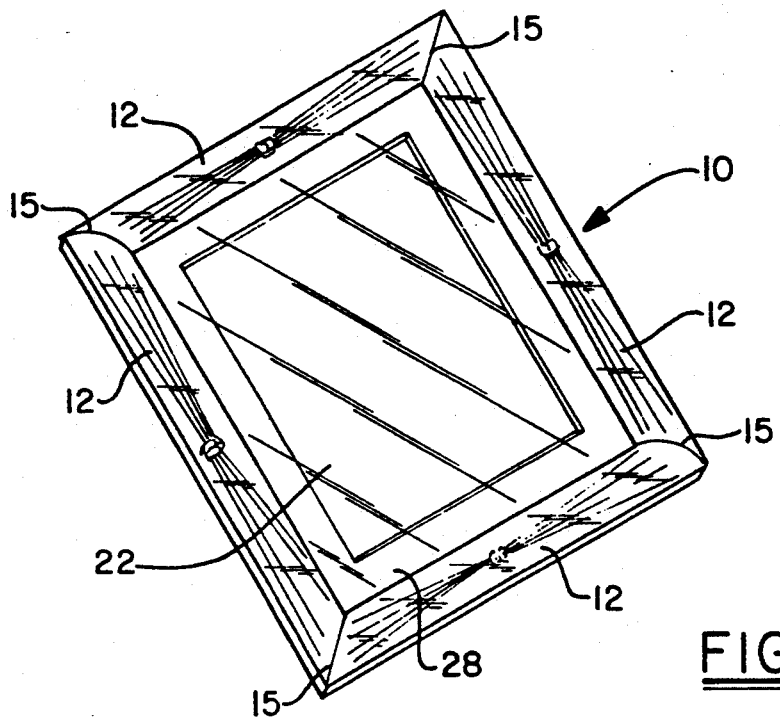
FIG. 1 is a perspective view of a picture frame according to the present invention.

| Part Number | Description |
|---|---|
| 10 | frame |
| 12 | framing member |
| 13 | peripheral edges |
| 14 | cavity-defining member |
| 15 | corners |
| 16 | cavity |
| 18 | decorative or appearance-altering material |
| 20 | unitary molded frame |
| 22 | base frame member |
| 24 | matboard |
| 26 | spacers |
| 28 | mat |
| 30 | picture |

-continued

DETAILED COMPONENT PART LIST

| Part Number | Description |
|---|---|
| 32 | backing member |
| 32a | back closure member |
| 34 | retaining means |
| 36 | supporting leg |
| 38 | hinge |
| 40 | lip |
| 42 | semicircular or elliptical frame member |
| 44 | square or rectangular frame member |
| 46 | polygonal frame member |
| 48 | triangular or trapezoidal frame member |
| 50 | framing kit |
| 52 | outer frame |
| 54 | base frame member |
| 55 | non-transparent base frame member |
| 56 | matboard |
| 58 | backing member |
| 60 | back closure member |
| 62 | retaining means |
| 64 | hinge |
| 66 | supporting leg |
| 68 | adhesive |
| 70 | screws |
| 72 | pre-drilled base frame member hole |
| 74 | pre-drilled outer frame hole |
| 76 | pre-drilled matboard hole |
| 78 | pre-drilled backing member hole |
| 80 | framing kit |
| 82 | outer frame |
| 84 | base frame member |
| 85 | non-transparent base frame member |
| 86 | matboard |
| 88 | backing member |
| 90 | back closure member |
| 92 | retaining means |
| 94 | hinge |
| 96 | supporting leg |
| 98 | adhesive |
| 100 | screws |
| 102 | pre-drilled base frame member hole |
| 104 | pre-drilled outer frame hole |
| 106 | pre-drilled matboard hole |
| 108 | pre-drilled backing member hole |
| 110 | framing kit |
| 112 | outer frame |
| 114 | base frame member |
| 116 | end caps |
| 118 | cylindrical outer member |
| 120 | cylindrical end cap |
| 122 | ancillary holder |
| 124 | adhesive |
| 126 | screws |
| 128 | pre-drilled outer frame hole |
| 130 | pre-drilled base frame member hole |

DETAILED DESCRIPTION OF THE INVENTION

Referring now to the drawings wherein the showings are for purposes of illustrating the preferred embodiment of the invention only and not for purposes of limiting the same, the Figures show a decorative framing border or enclosure device within which appearance-altering or decorative material may be positioned along the periphery. The framing borders are suitable with bulletin boards, vanity mirrors, placements, deskpads, towel bars, clocks, toilet seats, etc. Additionally, the devices are shown in kit form.

Referring to FIG. 1, a specific example of a picture frame is disclosed. Frame 10 contains a plurality of framing members 12, which are connected at a peripheral edge of frame 10 to form a continuous border. In a preferred embodiment, the framing members 12 are at least translucent, and in a most preferred embodiment, they are transparent. Particularly suitable for use as the material of construction of framing members 12 are the class of polymers generally referred to as acrylic resins. Acrylic resins in general are lightweight and very durable. They tend to retain clarity and clean exterior better than most plastics, which have a tendency to cloud or fade with age. Acrylic resins are relatively easy to work with and can readily be molded, extruded, cut and glued. Acrylic resins are thermoplastic polymers or copolymers of acrylic acid, methacrylic acid, esters of these acids, or acrylonitrile. A distinctive feature of cast sheet and extruded rods of acrylic resins is their ability to transfer light through the solid material.

While acrylic resins are suitable for the application, it is envisioned that other polymers would also be suitable for the application. Examples of such polymers are polystyrenes, polycarbonates, polyester resins, such as polyolefin terephthalates, (e.g. polyethylene terephthalate and polybutylene terephthalate), non-crystalline polyolefins, such as non-crystalline polyethylene, and non-crystalline polypropylene, and unsaturated polyester resins copolymerized with styrene. It is also within the scope of this invention to include halogenated derivatives of the polymers enumerated above, in addition to compatible copolymers of the above.

As shown in FIG. 1, frame 10 contains four framing members 12. Each framing member 12 is mitered at each end to permit snug union with its adjacent framing member at corners 15. When the picture frame is square or rectangular, this mitering is performed at an angle of 45° thereby permitting the formation of a perpendicular 90° positioning of the framing members 12. While FIG. 1 shows a generally square or rectangular frame, other geometric shapes are equally envisioned. For example, if a six-sided picture frame is desired, then the six framing members would be mitered at an angle of 30°. In general, an n-sided polygon will have framing members 12 mitered at an angle which is calculated by the formula of (360°/n/2). It is of course, realized that as the value of n approaches a high number, the geometric shape of the frame becomes spherical in nature.

Figure 2:
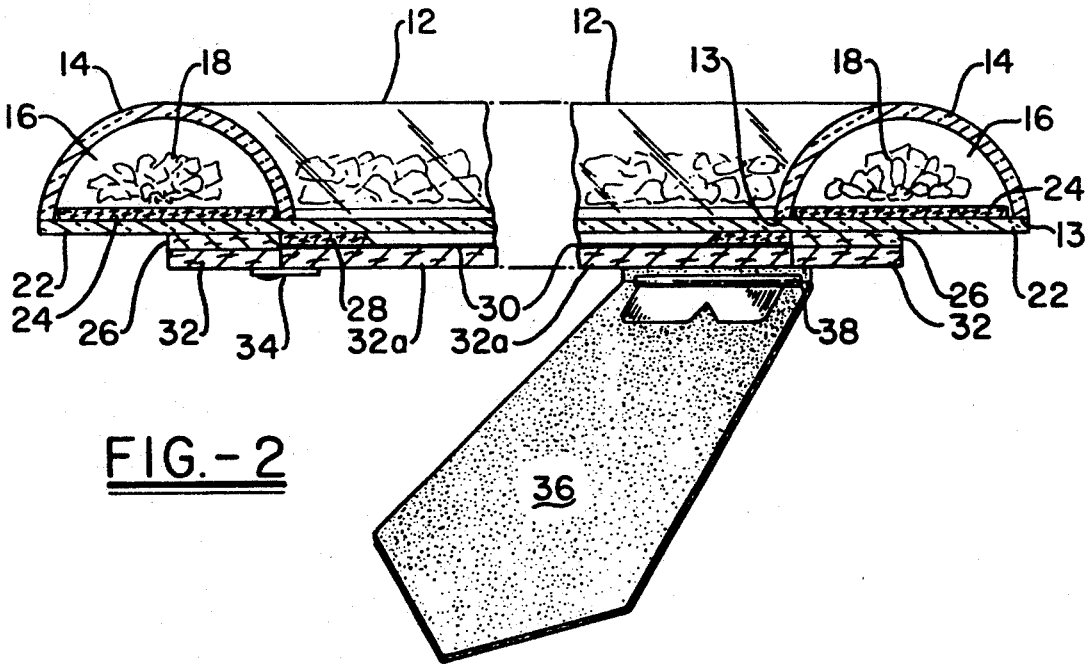
FIG. 2 is a greatly enlarged elevational view, partially broken away and in cross-section as may be taken on line 2—2 of FIG. 1, illustrating the various elements comprising the picture frame.

As illustrated better in FIG. 2, frame 10 is a multilayered product. In moving from the front to the back of the frame, there will be found framing members 12, which are attached to base frame member 22 at its peripheral edge. Underneath base frame member 22 are spacers 26 to which are attached backing member 32. The gap created between base frame member 22 and backing member 32, which is bounded by spacers 26, defines an interior region into which is inserted mat 28 and picture 30. Backing member 32 typically has a supporting leg 36 pivotally attached through hinge 38.

In one embodiment of the invention, spacers 26 are positioned on three sides of frame 10, thereby permitting the insertion of both mat 28 and picture 30 through the slot created in the vacant side.

In an alternative embodiment of the invention, spacers 26 are positioned on at least three sides of frame 10 and backing member 32 has a removable interior back closure member 32*a* thereby permitting the insertion of mat 28 through the slot created in the vacant side and picture 30 into the frame through the opening created by the removal of interior back closure member 32*a*. Interior back closure member 32*a* is retained in position in backing member 32 by retaining means 34. Retaining means 34 are typically clips, although other retaining means known in the art would also work.

As shown in FIG. 2, framing members 12 have inwardly opening cavities 16 into which decorative or appearance-altering material 18 and optionally a matboard 24 are inserted. The decorative or appearance-altering material can be almost limitless in nature. As illustrative of this type of material, the following list is provided, but the invention is not limited to such enumerated examples, but rather to the spirit and scope of classes of material listed: ribbon, shredded paper, streamers, potpourri, dried flowers, confetti, lace, rings or other wedding mementos, small photographs, beads, shredded paper currency, shredded plastic, buttons, and school paraphernalia (e.g. rubber bands, erasers, pencils, paper clips, pens, shredded paper, etc.). This list is not limiting the invention to the defined members, but rather is for illustrative purposes. The only limitation on the appearance-altering material is that it be capable of fitting into the inwardly opening cavities 16.

Figure 5:
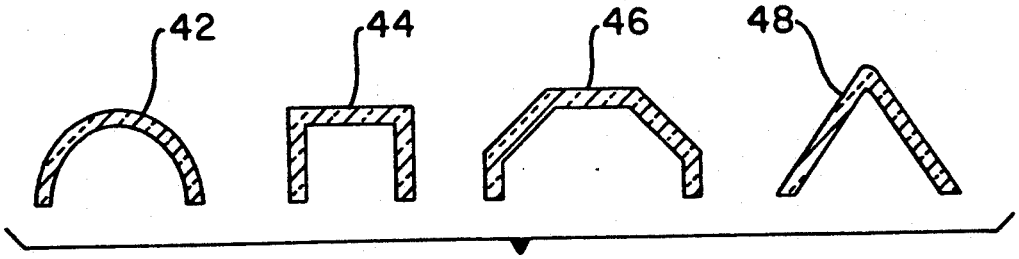
FIG. 5 is a cross-sectional view of several potential framing member shapes, such as a circle or ellipse; a square or rectangle; an n-sided polygon; and a trapezoid or triangle.

Framing member 12 has a cavity-defining member 14 and a pair of peripheral edges 13 which contact base frame member 22. As seen in FIG. 2, cavity-defining member 14 is semicircular. However, it is within the scope of the invention to have alternative shapes defining cavity 16. As shown in FIG. 5, semicircular or oval cavity-defining members 42, square or rectangular cavity-defining members 44, n-sided polygon-shaped cavity-defining members 46, and triangular or trapezoidal cavity-defining members 48 are envisioned.

During the manufacture of frame 10, framing members 12 are typically joined together with a clear adhesive well-known in the art. Subsequent to the gluing process, these glued framing members 12 are filled with the decorative or appearance-altering material 18 described previously. The polymeric frame is completed by using the clear adhesive to attach glued framing members 12 to one side of base frame member 22 thereby defining a front face of the frame 10. The frame is completed by attaching spacers 26 to at least three sides of the back face of base frame member 22. Spacers 26 are typically double-sided tape to which backing member 32 is attached.

While gluing is one attachment method, it is equally envisioned that alternative modes, such as using screws, are applicable. When used in this embodiment, in a preferred mode, the screws would be self-tapping screws. When screws are used, it is suggested that pre-drilled holes be utilized, so that the potential for cracking of the picture frame and/or components thereof, is minimized. It is known however, that ordinary threaded screws, could be used provided that the pre-drilled holes have been correspondingly threaded to a matching number of threads per inch design.

Figure 3:
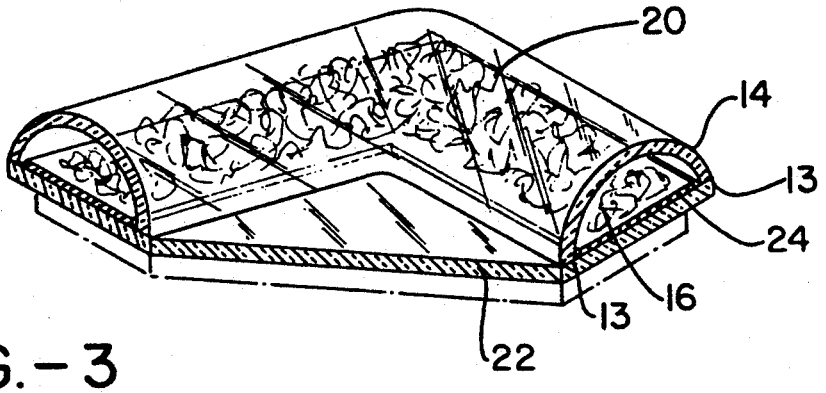
FIG. 3 is a partial perspective view of a corner of a picture frame of the present invention.

FIG. 3 illustrates an alternative embodiment of the invention where the plurality of framing members 12 have been replaced with a unitary molded frame 20 shown with a semicircular cavity-defining member 14 defining cavity 16. As was shown for framing members 12, unitary molded frame 20 has a pair of peripheral edges which are attached to the periphery of base frame member 22. The advantage of using unitary molded frame 20 lies in the ability to eliminate several processing steps, in addition to minimizing the alignment issue. As with the embodiment illustrated in FIG. 2, the shape of cavity-defining member 14 is not limited to the semicircular shape disclosed. Any closed geometric shape, as illustrated in FIG. 5, is applicable.

Figure 4:
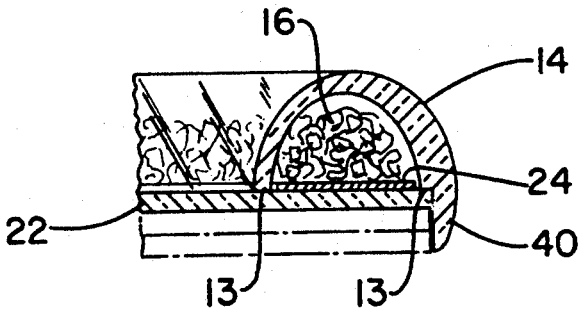
FIG. 4 is an enlarged elevational view, partially broken away and in cross-section as may be taken on line 4—4 of FIG. 1, illustrating a second embodiment of the framing members.

A further embodiment of the invention is illustrated in FIG. 4. As shown, framing member 12 has been modified to have lip 40 extending beyond peripheral edge 13 on the framing member's exterior side. The framing member's interior side has not been modified with the positioning of peripheral edge 13 remaining the same. The benefit of this configuration is that the positioning of base frame member 22 has been made foolproof. Lip 40 now defines a central cavity into which base frame member 22 is inserted without any ability for mis-positioning. This lipped configuration is suitable for positioning on both individual framing members 12 or on unitary molded frame 20. As with the embodiment illustrated in FIGS. 2 and 3, the shape of cavity-defining member 14 is not limited to the semi-circular shape disclosed. Any closed geometric shape, as illustrated in FIG. 5, is applicable.

When used as a picture frame, base frame member 22 is a transparent polymer or copolymer. However, there are applications when other types of materials would be preferred. For example, a cork board could function equally well as base frame member with framing members 12 or unitary molded frame 20 serving as the peripheral edge. Other materials, such as mirrors, masonite, or pegboard would also be candidate materials for base frame member 22.

It is also envisioned that when base frame member 22 is a transparent polymer or copolymer, a placemat or deskpad, rather than a picture frame would be the end-product. In this application, framing members are typically positioned at two opposing ends.

Figure 6:
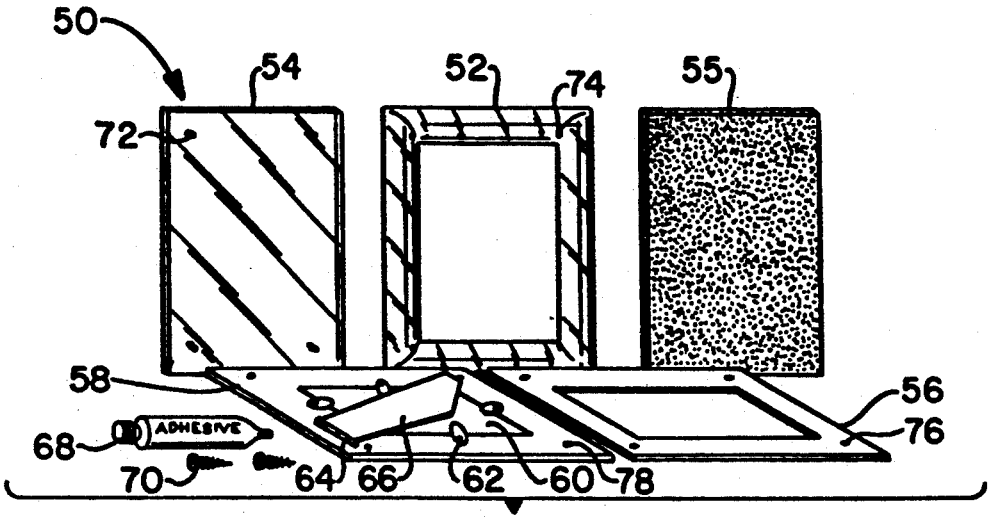
FIG. 6 is a perspective view of a framing kit which contains a unitary outer framing member, a protective cover, a mat, a backing member having a back closure member disposed therein, a tube of adhesive, and several screws, the members of the kit through which the screws are to be inserted containing pre-drilled holes.

FIG. 6 illustrates the decorative border or framing device in kit form. Given the simplicity of the products described, it is envisioned that almost anyone could produce a customized product. To meet the needs of this population, a do-it-yourself kit was created containing sufficient materials to produce different end products. In this form, the kit typically contains a unitary outer frame 52 optionally with pre-drilled holes 74, a base frame member 54 (transparent) optionally with pre-drilled holes 72, a non-transparent base frame member 55, a matboard 56 optionally with pre-drilled holes 76, and a backing member 58 optionally with pre-drilled holes 78. The backing member 58 can contain a back closure member 60 retained in position by retaining means 62 (typically clips), and supporting leg 66 pivotally attached to backing member 58 by hinge 64.

The final product can be assembled either by using an appropriate adhesive or by several self-tapping screws, or by a combination thereof. In this embodiment, unitary frame 52 can be similar in shape to that shown in FIG. 3, or can have peripheral lip 40 as shown in FIG. 4. Pre-drilled holes serve to facilitate the attachment of the component parts together while minimizing the risk of cracking the transparent polymer or copolymer components. Consistent with the previous discussion, base frame member 54 can be either a transparent plastic, thereby making it suitable for a picture frame application, or can be a cork board 55, thereby making it suitable for a bulletin board application. It is equally envisioned that the base frame member 54 could be a pegboard, masonite, mirror, etc. While unitary molded outer frame 52 is generally shown to be semicircular, it is envisioned that all of the shown closed geometric shapes disclosed in FIG. 5 are applicable.

Figure 7:
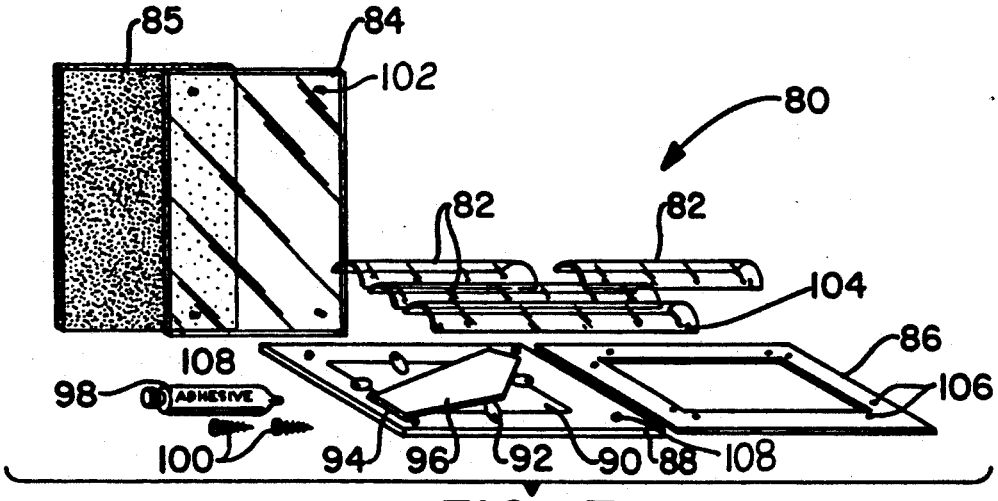
FIG. 7 is a perspective view of a framing kit which contains a plurality of outer framing members, a protective cover, a mat, a backing member having a back closure member disposed therein, a tube of adhesive, and several screws, the members of the kit through which the screws are to be inserted containing pre-drilled holes.

FIG. 7 also illustrates the decorative border or framing device in kit form. In this form, the kit typically contains a plurality of outer frame members 82 optionally with pre-drilled holes 104, a base frame member 84 (transparent) optionally with pre-drilled holes 102, a non-transparent base frame member (85), a matboard 86 optionally with pre-drilled holes 106, and a backing member 88 optionally with pre-drilled holes 108. The backing member 88 can contain a back closure member 90 retained in position by retaining means 92 (typically clips), and supporting leg 96 pivotally attached to backing member 88 by hinge 94.

The final product can be assembled either by using an appropriate adhesive or by several self-tapping screws, or by a combination thereof. In this embodiment, outer frame members 82 can be similar in shape to that shown in FIG. 1, or can have peripheral lip 40 as shown in FIG. 4. Pre-drilled holes serve to facilitate the attachment of the component parts together while minimizing the risk of cracking the transparent polymer or copolymer components. Consistent with the previous discussion, base frame member 84 can be either a transparent plastic, thereby making it suitable for a picture application, or can be a cork board 85, thereby making it suitable for a bulletin board application. It is equally envisioned that the base frame member 84 could be a pegboard, masonite, etc. While outer frame members 82 are generally shown to be semicircular, it is envisioned that all of the shown closed geometric shapes disclosed in FIG. 5 are applicable.

Figure 8:
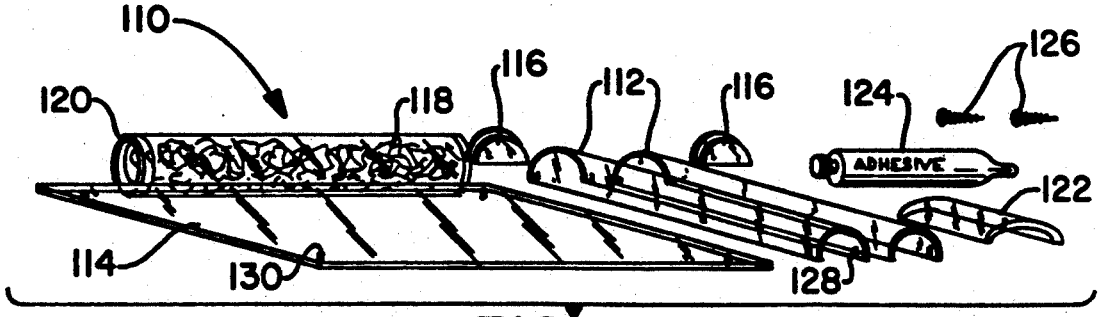
FIG. 8 is a perspective view of a framing kit for a deskpad or placemat which contains a plurality of outer framing members, a protective cover, a pair of matched end caps for each framing member, an ancillary holder, a tube of adhesive, and several screws, the members of the kit through which the screws are to be inserted containing pre-drilled holes.

FIG. 8 illustrates yet another embodiment of the invention. In this configuration, outer frame members are not circumferentially attached about a peripheral edge, but rather are discontinuous or at least semi-discontinuous. In this form, the kit typically contains a pair of outer frame members 112 optionally with pre-drilled holes 128, a pair of friction-fitting end caps 116 for each outer frame member 112, an ancillary holder 122, and a base frame member 114 optionally with pre-drilled holes 130.

The final product can be assembled either by using an appropriate adhesive or by several self-tapping screws, or by a combination thereof. Additionally, it is envisioned that for certain portions of the fabrication process, double stick tape, or other means known in the art could be used. In this embodiment, outer frame members 112 can be similar in shape to that shown in FIG. 8, or can have peripheral lip 40 as shown in FIG. 4. Pre-drilled holes serve to facilitate the attachment of the component parts together while minimizing the risk of cracking the transparent polymer or copolymer components.

The kit shown in FIG. 8 can additionally contain cylindrical outer frame members with friction-fitting cylindrical end caps 120. Consistent with the previous applications, the shape of outer frame 112 or supplemental frame member 118 can assume any of the geometric shapes shown in FIG. 5, with the shape of either end caps 116 or supplemental end caps 120 being chosen to frictionally fit into an end thereof.

DISCUSSION

The framing devices of the invention have a wide range of uses and applications. Framing borders, whether in the kit form, or as the final product, are applicable for use with pictures, bulletin boards, vanity mirrors, clocks, placemats, deskpads, towel bars, clocks, toilet seats, etc. One of the unique features of this application is the ability to separate the insertion of the appearance-altering material from that of the picture or photograph. It is the unique construction which allows the operations concerning the outer peripheral border and appearance-altering material positioning therein, from impacting the positioning of the photograph.

The decorative border isolates the appearance-altering material and enclosing framing members which are adapted for receiving such material to an upper first surface of the base frame member. The positioning of the mat and picture or photograph are restricted to operations which affect only the lower second surface of the base frame member. There is no cooperativity between the two surfaces of the base frame member which thereby permits the ability to change either the picture or the mat positioned on the lower second surface without simultaneously affecting the positioning of the appearance-altering material resident on the upper first surface.

What is claimed is:

1. An apparatus for framing objects comprising:

(a) an essentially transparent base frame member having a first and a second surface, each surface having a peripheral region and an interior region;

(b) a plurality of enclosing frame members, at least one frame member having a longitudinal channel open along a substantial portion of a length of the channel, at least one frame member being transparent;

(c) an appearance altering material disposed within the open channel of at least one frame member;

(d) a means for attaching the frame members about a portion of the peripheral region of the first surface of the base frame member to define the interior region by having an interior and exterior peripheral edge of the frame members contacting the first surface of the base frame member thereby creating an enclosed longitudinal channel;

(e) a backing member having peripheral sides and at least one essentially planar side, the backing member adapted to repeatedly receive and remove an object to be framed through at least one gap created between one peripheral side of the backing member and the second surface of the base frame member; and (f) a securing means affixing at least two opposed peripheral locations of the backing member to the second surface of the base frame member, the gap created between the backing member and the second surface of the base frame member being of a sufficient width to repeatedly receive and remove an object to be framed such that changing the framed object will not correspondingly affect the positioning of the appearance-altering material disposed within the open channel of at least one frame member on the first surface of the base frame member.

2. The apparatus of claim 1 wherein the enclosing frame members form a connected border about a periphery of the base frame member.

3. The apparatus of claim 1 wherein the base frame member is selected from the group consisting of a transparent polymer and a transparent copolymer.

4. The apparatus of claim 3 wherein the base frame member and the enclosing frame members are the transparent polymer selected from the group consisting of an acrylic resin, a polystyrene, a polycarbonate, a polyester resin, a non-crystalline polyolefin, and an unsaturated polyester resin copolymerized with styrene.

5. The apparatus of claim 1 wherein the means for attaching the enclosing frame members about a portion of the peripheral region of the first surface of the base frame member is selected from the group consisting of an adhesive and a screw.

6. The apparatus as defined in claim 1 wherein the enclosing frame members have a cross-sectional shape selected from the group consisting of semi-circular, semi-oval, n-sided polygon, triangle and trapezoid.

7. The apparatus of claim 1 wherein the enclosing frame members have an extending lip on the exterior peripheral edge, the extending lip adapted to receive the base frame member while simultaneously aligning the orientation of the enclosing frame members.

8. The apparatus of claim 1 wherein the gap is in direct communication with the outside environment.

9. The apparatus of claim 1 wherein the backing member further comprises a pivotally openable access region adapted to repeatedly receive and remove the object to be framed such that changing the framed object will not correspondingly affect the positioning of the appearance-altering material disposed within the open channel of at least one frame member on the first surface of the base frame member.

10. An apparatus for framing objects comprising:

(a) an essentially transparent base frame member having a first and a second surface, each surface having a peripheral region and an interior region;

(b) a unitary enclosing frame member, at least a portion of the frame member having a longitudinal channel open along a substantial portion of a length of the channel, at least a portion of the frame member being transparent;

(c) an appearance altering material disposed within the open channel of the unitary frame member; and (d) a means for attaching the unitary enclosing frame member about a portion of the peripheral region of the first surface of the base frame member to define the interior region by having an interior and exterior peripheral edge of the unitary enclosing frame member contacting the first surface of the base frame member thereby creating an enclosed longitudinal channel;

(e) a backing member having peripheral sides and at least one essentially planar side, the backing member adapted to repeatedly receive and remove an object to be framed through at least one gap created between one peripheral side of the backing member and the second surface of the base frame member; and (f) a securing means affixing at least two opposed peripheral locations of the backing member to the second surface of the base frame member, the gap created between the backing member and the second surface of the base frame member being of a sufficient width to repeatedly receive and remove an object to be framed such that changing the framed object will not correspondingly affect the positioning of the appearance-altering material disposed within the open channel of the unitary frame member on the first surface of the base frame member.

11. The apparatus of claim 10 wherein the base frame member is selected from the group consisting of a transparent polymer and a transparent copolymer.

12. The apparatus as defined in claim 11 wherein the base frame member and the unitary enclosing frame member are a transparent polymer selected from the group consisting of an acrylic resin, a polystyrene, a polycarbonate, a polyester resin, a non-crystalline polyolefin, and an unsaturated polyester resin copolymerized with styrene.

13. The apparatus of claim 10 wherein the means for attaching the unitary enclosing frame member about a portion of the peripheral region of the first surface of the base frame member is selected from the group consisting of an adhesive and a screw.

14. The apparatus as defined in claim 10 wherein the unitary enclosing frame member has a cross-sectional shape selected from the group consisting of semi-circular, semi-oval, n-sided polygon, triangle and trapezoid.

15. The apparatus of claim 10 wherein the unitary frame member has an extending lip on the exterior peripheral edge, the extending lip adapted to receive the base frame member while simultaneously aligning the orientation of the enclosing frame members.

16. The apparatus of claim 10 wherein the gap is in direct communication with the outside environment.

17. The apparatus of claim 10 wherein the backing member further comprises a pivotally openable access region adapted to repeatedly receive and remove the object to be framed such that changing the framed object will not correspondingly affect the positioning of the appearance-altering material disposed within the open channel of the unitary frame member on the first surface of the base frame member.

* * * * *